US008444308B2

(12) United States Patent
Matsunaga et al.

(10) Patent No.: US 8,444,308 B2
(45) Date of Patent: May 21, 2013

(54) VEHICULAR LAMP

(75) Inventors: Takashi Matsunaga, Shizuoka (JP); Ryujiro Ikuta, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 249 days.

(21) Appl. No.: 12/874,588

(22) Filed: Sep. 2, 2010

(65) Prior Publication Data

US 2011/0058387 A1 Mar. 10, 2011

(30) Foreign Application Priority Data

Sep. 7, 2009 (JP) ..... 2009-206150

(51) Int. Cl.
*B60Q 1/00* (2006.01)

(52) U.S. Cl.
USPC ..... 362/548; 362/547; 362/373; 362/800

(58) Field of Classification Search
USPC ..... 362/547, 545, 548, 373, 218, 264, 362/345
See application file for complete search history.

(56) References Cited

U.S. PATENT DOCUMENTS 7,290,913 B2 * 11/2007 Watanabe et al. ..... 362/545
2009/0207617 A1 * 8/2009 Merchant et al. ..... 362/294
2010/0067251 A1 * 3/2010 Tokunaga ..... 362/547
2011/0128754 A1 * 6/2011 Aiso et al. ..... 362/547
2011/0188204 A1 * 8/2011 Horiuchi et al. ..... 361/702

FOREIGN PATENT DOCUMENTS

JP 2008-084578 A 4/2008

OTHER PUBLICATIONS

English abstract of Japanese Publication No. 2008084578 published on Apr. 10, 2008, 1 page.

* cited by examiner

*Primary Examiner* — Jong-Suk (James) Lee
*Assistant Examiner* — Leah S Macchiarolo
(74) *Attorney, Agent, or Firm* — Osha Liang LLP

(57) ABSTRACT

A vehicular lamp has a semiconductor light emitting element as a light source. The vehicular lamp includes a heat dissipation member that dissipates heat generated by the semiconductor light emitting element; a power supply member that supplies power to the semiconductor light emitting element; a light emitting element holding portion that holds the semiconductor light emitting element in a state of contact with the heat dissipation member; and a housing portion that is secured to a lamp body. The light emitting element holding portion electrically connects the semiconductor light emitting element and the power supply member, the housing accommodates the power supply member and the heat dissipation member, and the light emitting element holding portion is detachably secured to the heat dissipation member.

16 Claims, 6 Drawing Sheets

VEHICULAR LAMP

BACKGROUND OF INVENTION

1. Field of the Invention

The present invention relates to a vehicular lamp. More specifically, the present invention relates to a vehicular lamp that includes a power supply member that supplies power from a power source to a semiconductor light emitting element that is a light source, and a housing portion that accommodates the power supply member.

2. Related Art

Semiconductor light emitting elements typified by light emitting diodes are increasingly used as light sources of automotive lamps (vehicular lamps) because they emit light with an extremely small current, and therefore, have a longer life and less power consumption compared to filament bulbs. A vehicular tail lamp is known that uses a semiconductor light emitting element as a light source (see Patent Document 1, for example). Semiconductor light emitting elements are also being used as light sources for headlamps, in addition to interior lamps, stop lamps, and the like, because higher intensity types of semiconductor light emitting elements have been developed in recent years.

[Patent Document 1] Japanese Patent Application Laid-Open (Kokai) No. 2008-84578

SUMMARY OF INVENTION

When a semiconductor light emitting element is used as a light source, a heat sink or the like for heat dissipation, for example, must be provided in order to efficiently dissipate heat generated from the element and a control circuit that controls the current supplied to the element. In this case, if a solder or a screw is used to secure the heat sink and the semiconductor light emitting element, the entire heat sink must also be replaced when the element is replaced.

In one or more embodiments, the present invention provides a vehicular lamp having a semiconductor light emitting element as a light source, the vehicular lamp characterized by including: a heat dissipation member that dissipates heat generated by the semiconductor light emitting element when lit; a power supply member that supplies power from a power source to the semiconductor light emitting element; a light emitting element holding portion that holds the semiconductor light emitting element in a state of contact with the heat dissipation member, and electrically connects the semiconductor light emitting element and the power supply member; and a housing portion that is secured to a lamp body, and accommodates the power supply member and the heat dissipation member, wherein the light emitting element holding portion is detachably secured to the heat dissipation member.

According to the vehicular lamp described above, the semiconductor light emitting element can be easily replaced by attaching and detaching the light emitting element holding portion. Further, the semiconductor light emitting element is in contact with the heat dissipation member due to the light emitting element holding portion. Therefore, heat from the semiconductor light emitting element can be efficiently dissipated.

In the vehicular lamp described above, the heat dissipation member is preferably formed of a metal material, and the light emitting element holding portion preferably puts a surface, having an electrical insulation property, of the semiconductor light emitting element in contact with the heat dissipation member.

Such planar contact of the heat dissipation member and the semiconductor light emitting element enables heat from the semiconductor light emitting element to be efficiently dissipated. In addition, even if the heat dissipation member is formed of an inexpensive metal material having good heat conductivity, it is possible to prevent the heat dissipation member from contacting and short circuiting an electrode of the semiconductor light emitting element or the like.

In the vehicular lamp described above, the semiconductor light emitting element and the power supply member are preferably provided on opposite sides of the heat dissipation member in a lamp longitudinal direction with the heat dissipation member interposed therebetween.

Consequently, compared to providing the semiconductor light emitting element and the power supply member on the same side of the heat dissipation member, it is easier to secure a space for contacting the semiconductor light emitting element to the heat dissipation member.

In the vehicular lamp described above, it is preferable that the light emitting element holding portion detachably holds the power supply member.

Thus, the power supply member can be secured to the heat dissipation member by the light emitting element holding portion. Therefore, it is not necessary to provide a structure on the power supply member for securing the power supply member to the heat dissipation member.

Other aspects and advantages of the invention will be apparent from the following description, the drawings and the claims.

DETAILED DESCRIPTION

Hereinafter, the present invention will be described with reference to the figures. All of the features and the combinations thereof described in the embodiments set forth below are not necessarily essential and one or more aspects of the invention may be included in one or more embodiments.

Figure 1:
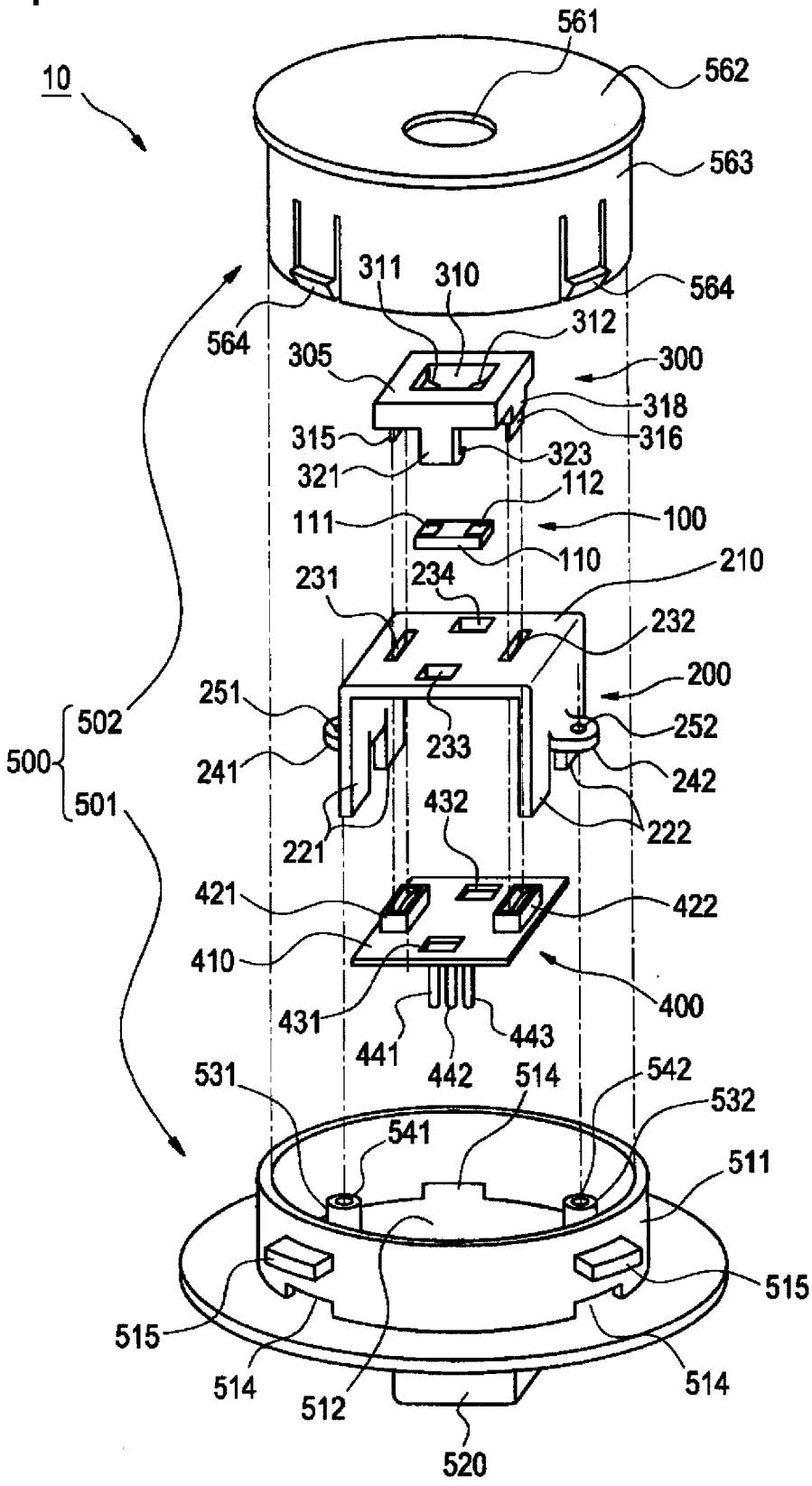
FIG. 1 is an exploded perspective view of a vehicular lamp 10 according to an embodiment of the present invention.
Figure 2:
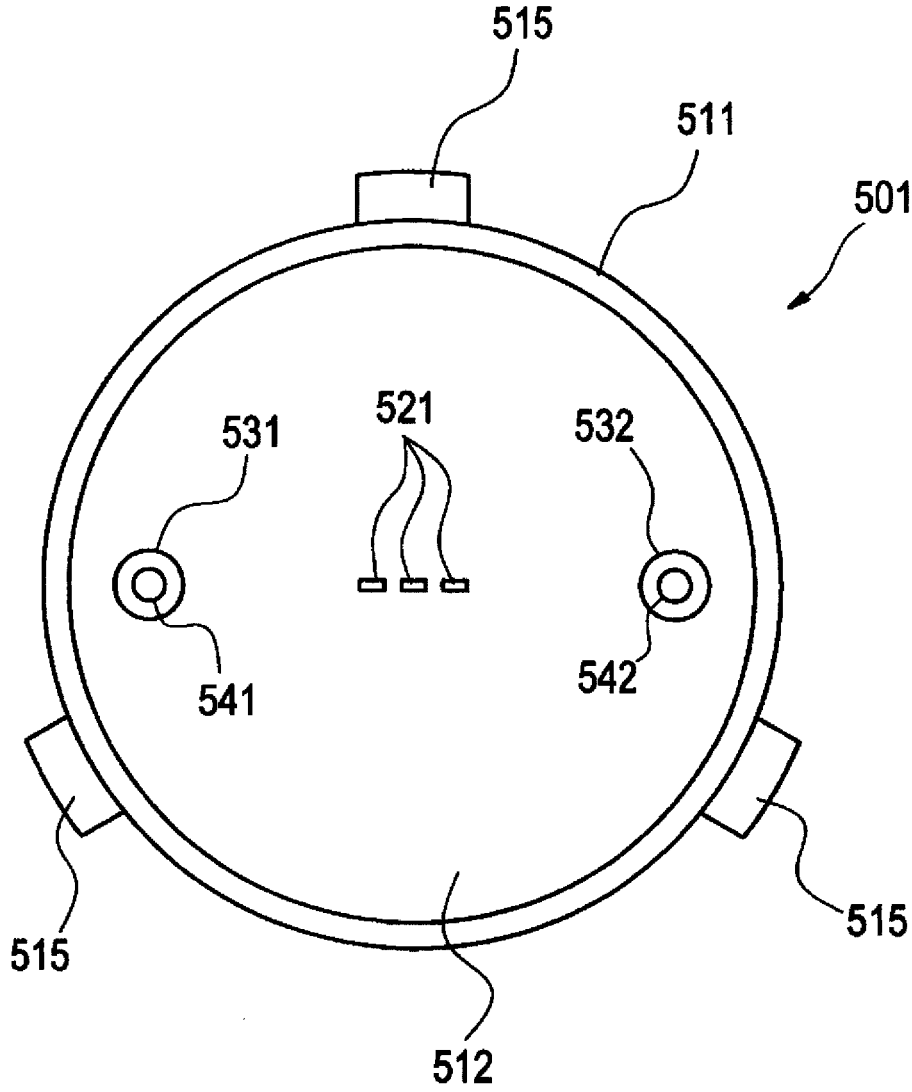
FIG. 2 is a view of a lower housing portion 501 as seen from a top side.
Figure 3:
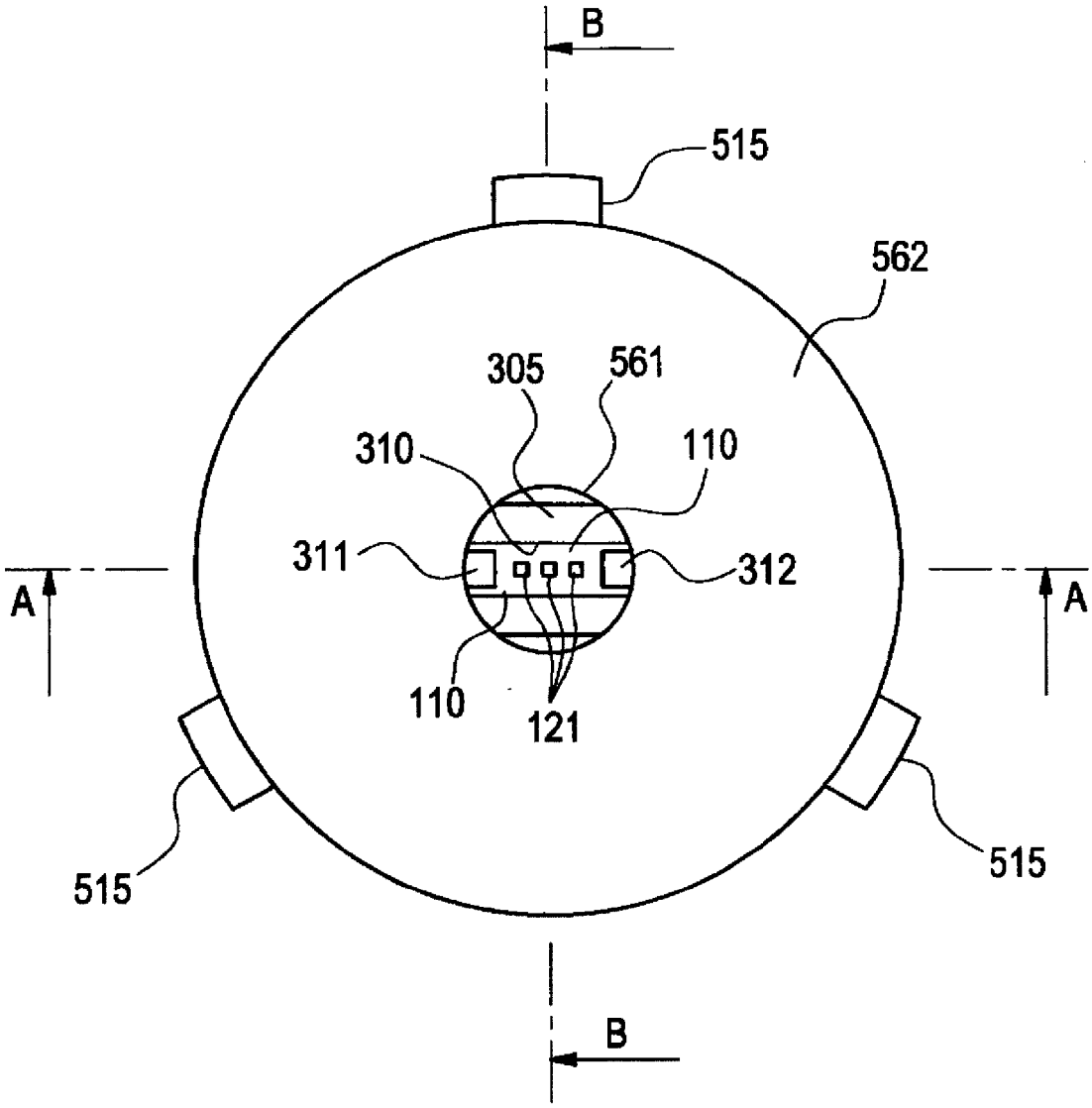
FIG. 3 is a view as seen from a lamp front side with a light emitting element 100, a heat dissipation member 200, a light emitting element holding portion 300, and a power supply member 400 attached to the lower housing portion 501.
Figure 4:
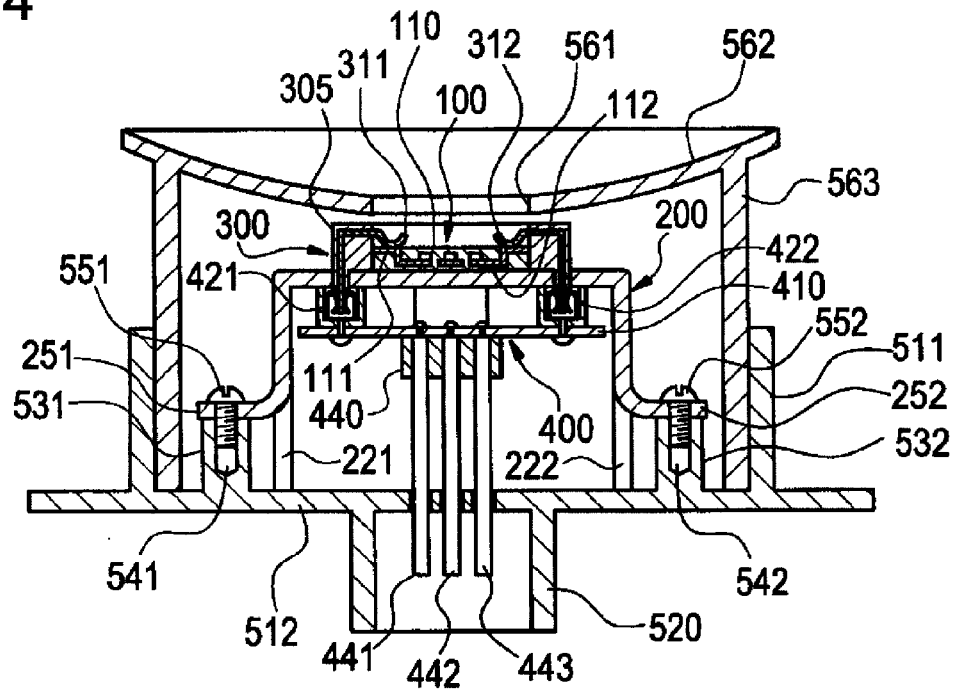
FIG. 4 is a cross-sectional view in the direction of arrows A-A in FIG. 3.
Figure 5:
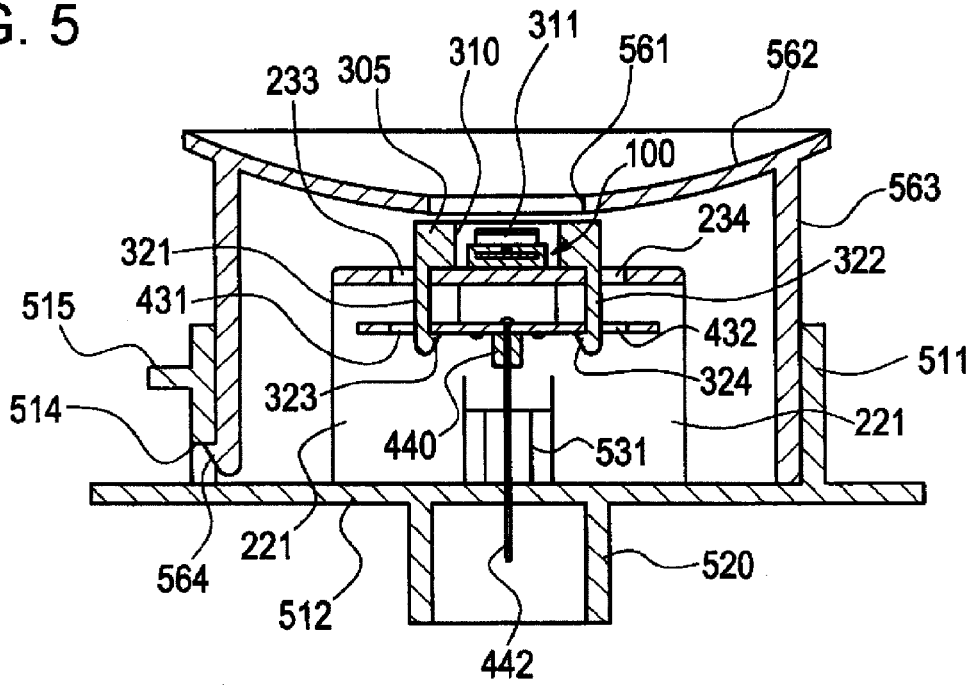
FIG. 5 is a cross-sectional view in the direction of arrows B-B in FIG. 3.
Figure 6:
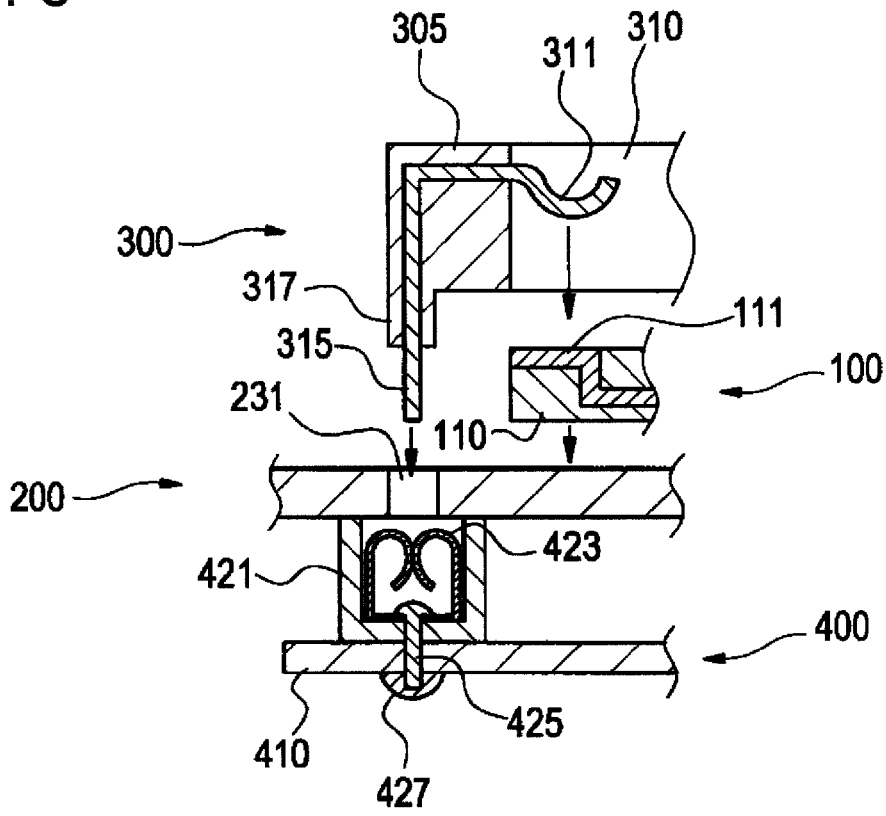
FIG. 6 is a view that shows connecting of a connector 421 and an electrode 315.
Figure 7:
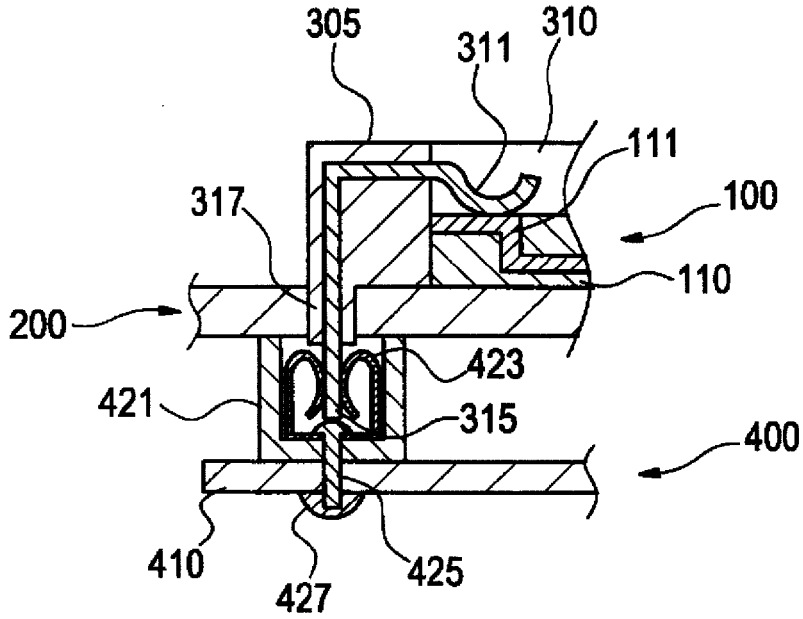
FIG. 7 is a view that shows connecting of the connector 421 and the electrode 315.

FIG. 1 is an exploded perspective view of a vehicular lamp 10 according to an embodiment of the present invention. FIG. 2 is a view of a lower housing portion 501 as seen from a top side. FIG. 3 is a view as seen from a lamp front side with a light emitting element 100, a heat dissipation member 200, a light emitting element holding portion 300, and a power supply member 400 attached to the lower housing portion 501. FIG. 4 is a cross-sectional view in the direction of arrows A-A in FIG. 3. FIG. 5 is a cross-sectional view in the direction of arrows B-B in FIG. 3. FIGS. 6 and 7 are views that show connecting of a connector 421 and an electrode 315.

Note that in the description herein "forward of the lamp" refers to a direction of illumination by the vehicular lamp 10, and is an upward direction in FIGS. 1 and 4 to 7 and a vertically upward direction with respect to the paper in FIGS. 2 and 3. "Rearward of the lamp" is a downward direction in FIGS. 1 and 4 to 7 and a vertically downward direction with respect to the paper in FIGS. 2 and 3.

As shown in FIG. 1, the vehicular lamp 10 includes the light emitting element 100, the heat dissipation member 200, the light emitting element holding portion 300, the power supply member 400, and a housing portion 500. The vehicular lamp 10 uses the light emitting element 100 attached to the power supply member 400 as a light source, and functions as a tail lamp and a brake lamp disposed at the rear of the vehicle, for example. Note that the vehicular lamp 10 may also be applied to a headlamp that illuminates forward of the vehicle.

The light emitting element 100 is an example of a semiconductor light emitting element in accordance with one or more embodiments of the present invention. The light emitting element 100 has a package portion 110 on which a plurality (three in the present example) of LED chips 121, which are electrically connected by a lead frame and bonding wires (not shown in the drawings), is sealed by a transparent resin material in a general parallelepiped configuration. Note that a resin having an electrical insulation property may also be used for the above sealing.

A portion of the lead frame is exposed as electrodes 111, 112 on both sides of one surface of the package portion 110. The electrodes 111, 112 are connecting terminals that connect to the LED chip 121 and a power source (not shown in the drawings). Specifically, one of the electrodes 111, 112 is a positive terminal of the light emitting element 100, and the other is a ground terminal of the light emitting element 100.

In the light emitting element 100 of the present example, a surface provided with the electrodes 111, 112 is a light emitting surface. Specifically, the light emitting element 100 emits light between the electrode 111 and the electrode 112 from the surface provided with the electrodes 111, 112, and has an optical axis in a direction perpendicular to the light emitting surface.

The heat dissipation member 200 is a member provided in order to efficiently release heat generated by the light emitting element 100 in particular to outside when the light emitting element 100 is lit. The heat dissipation member 200 is formed of a metal material with excellent heat conductivity, such as aluminum, for example. As shown in FIG. 1, the heat dissipation member 200 of the present example has a generally oblong planar portion 210 whose surface is flat and smooth, and extension portions 221, 222 that extend from both sides of the planar portion 210 in a direction perpendicular to the planar portion 210. At generally center portions of the extension portions 221, 222, flange portions 241, 242 are provided by bending a portion of the extension portions 221, 222 outward. The flange portions 241, 242 are formed with through holes 251, 252 into which screws 551, 552 are inserted when securing the heat dissipation member 200 to the housing portion 500.

In addition, the planar portion 210 is provided with through holes 231, 232, 233, 234 along four sides thereof. Among the four through holes 231 to 234, opposing through holes respectively have the same hole shape. Specifically, the through hole 231 and the through hole 232 have the same hole shape, and the through hole 233 and the through hole 234 have the same hole shape.

The heat dissipation member 200 is arranged more toward a lamp rearward side than the light emitting element holding portion 300 and the light emitting element 100 when assembled as the vehicular lamp 10. As shown in FIGS. 4 and 5, the light emitting element 100 is held between the light emitting element holding portion 300 and the heat dissipation member 200. In such case, a surface on the opposite side of the light emitting surface on the package portion 110 of the light emitting element 100 is in contact with a surface on a lamp forward side of the planar portion 210 of the heat dissipation member 200. Thus, heat generated by the light emitting element 100 when the light emitting element 100 is lit can be efficiently dissipated by planar contact between the heat dissipation member 200 and the light emitting element 100.

Note that, as described above, conductive portions of the LED chip 121, the lead frame, and the like of the light emitting element 100 are sealed inside the package portion 110 except for the electrodes 111, 112 that are exposed to the lamp forward side. Therefore, even if the heat dissipation member 200 and a surface on the opposite side of the light emitting surface of the light emitting element 100 are in planar contact, the conductive portions of the light emitting element 100 do not contact the heat dissipation member 200 and short circuit.

The light emitting element holding portion 300 has a holding portion body 305 with a general parallelepiped configuration, and a pair of engagement projections 321, 322 that extend from the holding portion body 305 parallel to side surfaces of the holding portion body 305. The holding portion body 305 and the engagement projections 321, 322 are formed of a resin material having an electrical insulation property in the present example.

In addition, the holding portion body 305 is provided with a generally oblong opening portion 310 that penetrates from an upper surface to a lower surface. The engagement projections 321, 322 extend from the holding portion body 305 along a pair of opposing side surfaces on the holding portion body 305, and distal end portions thereof are provided with engagement tabs 323, 324 that project inward.

The light emitting element holding portion 300 further has electrodes 311, 312 that project toward an inner side of the opening portion 310, and a pair of electrodes 315, 316 that extend from the holding portion body 305 parallel to side surfaces of the holding portion body 305. The electrodes 315, 316 are covered by covering portions 317, 318 that extend a predetermined length from the holding portion body 305. The covering portions 317, 318 are formed of a material having an electrical insulation property.

As shown in FIGS. 4, 6, and 7, the electrode 311 and the electrode 315 are electrically connected in an inner portion of the holding portion body 305. Likewise, the electrode 312 and the electrode 316 are electrically connected in an inner portion of the holding portion body 305.

The power supply member 400 has a circuit board 410 that is provided with a pair of through holes 431, 432 that penetrate from an upper surface to a lower surface, connectors 421, 422 that are secured on the upper surface of the circuit board 410, and electrodes 441, 442, 443 that are secured on the lower surface of the circuit board 410. The circuit board 410 is provided in order to supply power from the power source to the light emitting element 100 and to control a current value thereof. The circuit board 410 may be a bus bar circuit board or a printed circuit board, for example. Note that a rectifier diode, a current control resistance, and the like are arranged on the circuit board 410, but are not shown in the drawings.

As shown in FIGS. 6 and 7, the connector 421 has an outer frame with a general parallelepiped configuration whose upper side is open, and a flexible electrode 423 that is arranged in an inner portion of the outer frame. The flexible electrode 423 is provided along an inner surface of the outer frame of the connector 421. As shown in FIGS. 6 and 7, both ends of the flexible electrode 423 bend inward in the vicinity of the opening portion that opens to outside in the outer frame.

The flexible electrode 423 of the connector 421 is electrically connected to an end of a conductive securing pin 425 that penetrates the outer frame of the connector 421. As shown in FIGS. 6 and 7, the securing pin 425 passes through the circuit board 410 and an end portion thereof is secured by solder 427. Thus, the flexible electrode 423 of the connector 421 is electrically connected to the circuit board 410 through the securing pin 425. As the structure of the connector 422 is identical to the structure of the connector 421 explained above, it will not be described here.

The electrodes 441 to 443 vertically project from the lower surface of the circuit board 410. In the present example, the electrodes 441 to 443 are elongated metal plates with generally oblong cross sections, and are secured by solder to the circuit board 410. The electrodes 441 to 443 are supported by a support portion 440 that is secured to the circuit board 410.

The housing portion 500 is formed from an upper housing portion 502 and the lower housing portion 501. As shown in FIG. 2, the lower housing portion 501 has a bottom wall 512, a side wall 511, a connector 520, and heat dissipation member securing portions 531, 532.

The side wall 511 extends from an outer edge of the generally disc-shaped bottom wall 512 perpendicular to the bottom wall 512. The heat dissipation member securing portions 531, 532 also extend from the bottom wall 512 in the same direction as the side wall 511. In the present example, the heat dissipation member securing portions 531, 532 are generally shaped as cylinders and respectively provided with screw holes 541, 542. The connector 520 extends from a center portion of the bottom wall 512 toward a side opposite the extension direction of the side wall 511. The center portion of the bottom wall 512 is provided with a plurality (three in the present example) of through holes 521 that penetrate the bottom wall 512. The through holes 521 are provided to be inserted with the electrodes 441, 442, 443 of the power supply member 400 and allow their projection toward the connector 520 side.

As shown in FIG. 2, the lower housing portion 501 is provided with an engagement projection 515 at regular intervals in a circumferential direction (three locations at 120-degree intervals in the present example). The engagement projections 515 are used for securing the housing portion 500 to a lamp body 600 that will be described later.

The upper housing portion 502 has a concave surface portion 562 that is provided with an opening 561 at its center, and a generally cylindrical side wall 563 that vertically extends from the concave surface portion 562. The concave surface portion 562 is formed with a surface that convexly curves in an extending direction of the side wall 563 on a side opposite the side from which the side wall 563 extends. A substance with high reflectivity such as aluminum is vapor-deposited on the curved surface.

The side wall 563 of the upper housing portion 502 is provided with a fitting projection 564 at regular intervals in the circumferential direction (three locations at 120-degree intervals in the present example). In addition, the side wall 511 of the lower housing portion 501 is provided with a fitting hole 514 at regular intervals in the circumferential direction (three locations at 120-degree intervals in the present example).

Components forming the vehicular lamp 10 were described above. These components are arranged, from the lamp forward side, in the order of the upper housing portion 502, the light emitting element holding portion 300, the light emitting element 100, the heat dissipation member 200, the power supply member 400, and the lower housing portion 501.

When assembled as the vehicular lamp 10, the light emitting element 100 is supported by the light emitting element holding portion 300 with a surface on the opposite side of the light emitting surface on the package portion 110 in a state of contact with the planar portion 210 of the heat dissipation member 200.

Specifically, as shown in FIGS. 6 and 7, the light emitting element holding portion 300 is attached such that the light emitting element 100 is interposed between the light emitting element holding portion 300 and the heat dissipation member 200, with the light emitting element 100 mounted at the general center of the planar portion 210 of the heat dissipation member 200 such that the light emitting surface faces forward of the lamp. At such time, the electrodes 315, 316 of the light emitting element holding portion 300 pass through the through holes 231, 232 of the heat dissipation member 200.

Distal end portions of the electrodes 315, 316 passed through the through holes 231, 232 are subsequently inserted into the connectors 421, 422 of the power supply member 400, which is arranged on the side opposite the heat dissipation member 200. At such time, in the connector 421 for example, the flexible electrode 423 deforms while deflecting to both sides and contacts the inserted electrode 315 from both sides. Although not shown in the drawings, a flexible electrode in an inner portion of the connector 422 contacts the electrode 316 from both sides, similar to the connector 421.

At such time, the engagement projections 321, 322 of the light emitting element holding portion 300 pass through the through holes 233, 234 of the heat dissipation member 200 and the through holes 431, 432 of the power supply member 400. As shown in FIG. 5, the engagement tabs 323, 324 on the distal ends of the engagement projections 321, 322 catch on the circuit board 410. Thus, the light emitting element holding portion 300 is secured to the heat dissipation member 200, and at the same time, holds the power supply member 400 that is arranged on the side opposite the heat dissipation member 200.

Accordingly, the light emitting element 100 is accommodated in the opening portion 310 of the light emitting element holding portion 300, and the electrodes 111, 112 of the light emitting element 100 contact the electrodes 311, 312 of the light emitting element holding portion 300. Therefore, the light emitting element 100 is held in a lamp longitudinal direction by the planar portion 210 of the heat dissipation member 200 and the electrodes 311, 312 of the light emitting element holding portion 300, and held in a lamp sideward direction by the holding portion body 305 of the light emitting element holding portion 300.

Note that, in the present example, the light emitting element holding portion 300 is secured to the heat dissipation member 200 by the engagement tabs 323, 324 on the distal ends of the engagement projections 321, 322 catching on the circuit board 410 with the heat dissipation member 200 interposed therebetween. Therefore, the light emitting element 100 and the power supply member 400 can be removed again from the heat dissipation member 200 by detaching the engagement tabs 323, 324 from the circuit board 410.

In addition, as shown in FIG. 7, inner walls of the through holes 231, 232 of the heat dissipation member 200 are in contact with the covering portions 317, 318, but do not contact the heat dissipation member 200 or the electrodes 315, 316. Therefore, an electrical insulation property is maintained between the electrodes 315, 316 and the heat dissipation member 200.

Thus, in the vehicular lamp 10 of the present example, the light emitting element holding portion 300 detachably holds the light emitting element 100 and the power supply member 400. Accordingly, the light emitting element 100 and the power supply member 400 can be easily replaced, and the light emitting element 100 and the power supply member 400 can be held using one component. Therefore, the structure for attaching the power supply member 400 to the heat dissipation member 200, and the like, can be simplified.

The heat dissipation member 200 to which the light emitting element 100, the light emitting element holding portion 300, and the power supply member 400 are secured is attached to the lower housing portion 501 with the surface of the planar portion 210 on which the light emitting element 100 is arranged on an upper side. In the present example, as shown in FIG. 4, the heat dissipation member 200 is secured to an inner portion of the lower housing portion 501 by inserting the screws 551, 552 into the through holes 251, 252 formed in the flange portions 241, 242 of the heat dissipation member 200 and into the screw holes 541, 542 provided in the heat dissipation member securing portions 531, 532 of the lower housing portion 501. Here, the extension portions 221, 222 of the heat dissipation member 200 bend in the lamp longitudinal direction. Therefore, as shown in FIGS. 1 and 4, the extension portions 221, 222 do not interfere when attaching the heat dissipation member 200 to the lower housing portion 501.

Next, the upper housing portion 502 is fitted to the lower housing portion 501 such that an outer surface of the side wall 563 of the upper housing portion 502 and an inner surface of the side wall 511 of the lower housing portion 501 slide against each another. Here, the upper housing portion 502 and the lower housing portion 501 are secured to one another by fitting the fitting projection 546 of the upper housing portion 502 into the fitting hole 514 of the lower housing portion 501.

In the vehicular lamp 10 assembled as described above, as shown in FIGS. 3 to 5, the light emitting surface of the light emitting element 100 is exposed from the opening 561 of the upper housing portion 502. The optical axis direction of the light emitting element 100 generally coincides with the lamp longitudinal direction (a vertical direction in FIGS. 4 and 5). In addition, the electrodes 441, 442, 443 of the power supply member 400 are inserted into the through holes 521 provided in the bottom wall 512 of the lower housing portion 501, and project from the center portion of the connector 520 in the lamp rearward direction.

Figure 8:
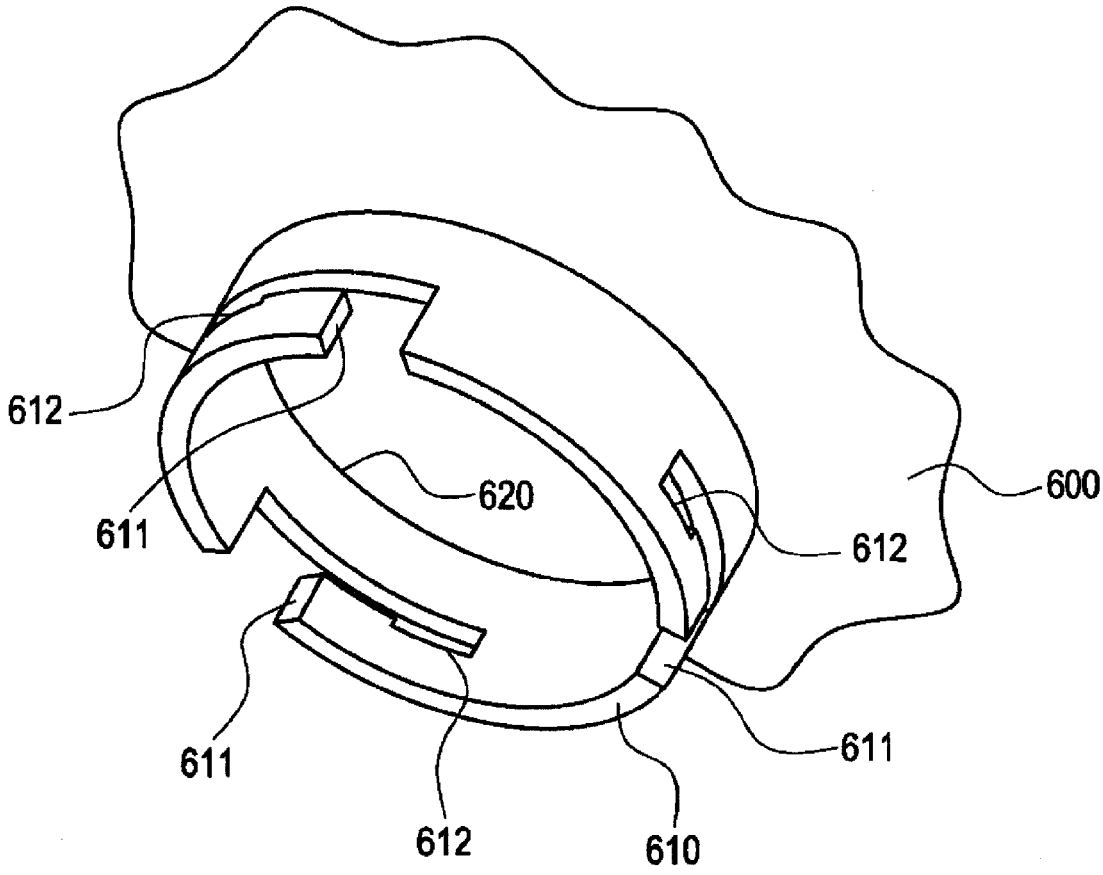
FIG. 8 is an enlarged view of the vicinity of a lamp attachment portion 610 of a lamp body 600.

FIG. 8 is an enlarged view of the vicinity of a light source attachment portion 610, to which the vehicular lamp 10 is attached, of the lamp body 600. The vehicular lamp 10 described above is attached to the light source attachment portion 610 provided in the lamp body 600 of a vehicle headlight as shown in FIG. 8, for example.

The light source attachment portion 610 is a generally cylindrical member provided at the center of the lamp body 600, and an end thereof is connected to an opening 320 provided in the lamp body 600. An inner circumferential diameter of the light source attachment portion 610 is generally equivalent to an outer circumferential diameter of the lower housing portion 501 of the vehicular lamp 10. The light source attachment portion 610 is also formed with an engagement groove 611 at regular intervals in the circumferential direction (three locations at 120-degree intervals in the present example).

When attaching the vehicular lamp 10 to the lamp body 600, first, the engagement projection 515 on the vehicular lamp 10 side is inserted into the engagement groove 611 of the light source attachment portion 610. By rotating the vehicular lamp 10 such that the engagement projection 515 is guided by the engagement groove 611, the engagement projection 515 fits into an engagement recess portion 612 formed on an end of the engagement groove 611. Thus, the vehicular lamp 10 is secured to the lamp body 600.

While description has been made in connection with exemplary embodiments of the present invention, it will be obvious to those skilled in the art that various changes and modification may be made therein without departing from the present invention. It is aimed, therefore, to cover in the appended claims all such changes and modifications falling within the true spirit and scope of the present invention.

DESCRIPTION OF THE REFERENCE NUMERALS

10 VEHICULAR LAMP
100 LIGHT EMITTING ELEMENT (SEMICONDUCTOR LIGHT EMITTING ELEMENT)
110 PACKAGE PORTION
121 LED CHIP
200 HEAT DISSIPATION MEMBER
210 PLANAR PORTION
221, 222 EXTENSION PORTION
231, 232, 233, 234 THROUGH HOLE
241, 242 FLANGE PORTION
251, 252 THROUGH HOLE
300 LIGHT EMITTING ELEMENT HOLDING PORTION
305 HOLDING PORTION BODY
310 OPENING PORTION
311, 312 ELECTRODE
315, 316 ELECTRODE
317, 318 COVERING PORTION
400 POWER SUPPLY MEMBER
410 CIRCUIT BOARD
421, 422 CONNECTOR
423 FLEXIBLE ELECTRODE
425 SECURING PIN
427 SOLDER
431, 432 THROUGH HOLE
440 SUPPORT CASE
441, 442, 443 ELECTRODE
500 HOUSING PORTION
501 LOWER HOUSING PORTION
502 UPPER HOUSING PORTION
511 SIDE WALL
512 BOTTOM WALL
514 THROUGH HOLE
515 ENGAGEMENT PROJECTION
520 CONNECTOR
521 INSERTION HOLE
531, 532 HEAT DISSIPATION MEMBER SECURING PORTION
541, 542 SCREW HOLE
551, 552 SCREW
561 OPENING
562 CONCAVE SURFACE PORTION
563 SIDE WALL
564 FITTING PROJECTION
600 LAMP BODY
610 LIGHT SOURCE ATTACHMENT PORTION
611 ENGAGEMENT GROOVE

612 ENGAGEMENT RECESS PORTION

620 OPENING

What is claimed is:

1. A vehicular lamp having a semiconductor light emitting element as a light source, the vehicular lamp comprising:

a heat dissipation member that dissipates heat generated by the semiconductor light emitting element;

a power supply member that supplies power to the semiconductor light emitting element;

a light emitting element holding portion that holds the semiconductor light emitting element in a state of contact with the heat dissipation member; and a housing portion that is secured to a lamp body, wherein the light emitting element holding portion electrically connects the semiconductor light emitting element and the power supply member, wherein the housing accommodates the power supply member and the heat dissipation member, and wherein the light emitting element holding portion is detachably secured to the heat dissipation member.

2. The vehicular lamp according to claim 1, wherein the heat dissipation member is formed of a metal material, and wherein the light emitting element holding portion is arranged such that a surface, having an electrical insulation property, of the semiconductor light emitting element contacts the heat dissipation member.

3. The vehicular lamp according to claim 2, wherein the semiconductor light emitting element and the power supply member are provided on opposite sides of the heat dissipation member in a lamp longitudinal direction with the heat dissipation member interposed therebetween.

4. The vehicular lamp according to claim 3, wherein the light emitting element holding portion detachably holds the power supply member.

5. The vehicular lamp according to claim 4, wherein the light emitting element holding portion comprises engagement portions adapted to detachably engage through holes disposed in the heat dissipation member and power supply member.

6. The vehicular lamp according to claim 5, wherein the light emitting element holding portion further comprises electrodes adapted to electrically connect the semiconductor light emitting element and the power supply member via through holes in the heat dissipation member.

7. The vehicular lamp according to claim 6, wherein the housing comprises an upper housing portion and lower housing portion, wherein the upper housing portion is detachably secured to the lower housing portion.

8. The vehicular lamp according to claim 7, wherein the heat dissipation member is detachably secured to the lower housing portion.

9. The vehicular lamp according to claim 8, wherein the upper housing portion comprises a concave surface portion with high reflectivity having an opening that allows light from the semiconductor light emitting element to pass through.

10. The vehicular lamp according to claim 9, wherein the surface of the light emitting element holding portion that contacts the heat dissipation member is formed of a resin material.

11. The vehicular lamp according to claim 1, wherein the semiconductor light emitting element and the power supply member are provided on opposite sides of the heat dissipation member in a lamp longitudinal direction with the heat dissipation member interposed therebetween.

12. The vehicular lamp according to claim 11, wherein the light emitting element holding portion detachably holds the power supply member.

13. A method of manufacturing a vehicular lamp having a semiconductor light emitting element as a light source, the method comprising:

disposing a heat dissipation member that dissipates heat generated by the semiconductor light emitting element into a housing portion;

disposing a power supply member that supplies power to the semiconductor light emitting element into the housing portion;

disposing a light emitting element holding portion that holds the semiconductor light emitting element in a state of contact with the heat dissipation member into the housing portion;

securing the housing portion to a lamp body;

wherein the light emitting element holding portion electrically connects the semiconductor light emitting element and the power supply member, and wherein the light emitting element holding portion is detachably secured to the heat dissipation member.

14. The method of manufacturing a vehicular lamp according to claim 13 further comprising:

forming the heat dissipation member of a metal material, and arranging the light emitting element holding portion such that a surface, having an electrical insulation property, of the semiconductor light emitting element contacts the heat dissipation member.

15. The method of manufacturing a vehicular lamp according to claim 14 further comprising:

providing the semiconductor light emitting element and the power supply member on opposite sides of the heat dissipation member in a lamp longitudinal direction with the heat dissipation member interposed therebetween.

16. The method of manufacturing a vehicular lamp according to claim 15, wherein the light emitting element holding portion detachably holds the power supply member.

* * * * *